US007915798B2

(12) United States Patent
Liu et al.

(10) Patent No.: US 7,915,798 B2
(45) Date of Patent: Mar. 29, 2011

(54) THERMIONIC EMISSION DEVICE

(75) Inventors: Peng Liu, Beijing (CN); Liang Liu, Beijing (CN); Kai-Li Jiang, Beijing (CN); Shou-Shan Fan, Beijing (CN)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 266 days.

(21) Appl. No.: 12/288,996

(22) Filed: Oct. 23, 2008

(65) Prior Publication Data

US 2010/0039015 A1 Feb. 18, 2010

(30) Foreign Application Priority Data

Dec. 29, 2007 (CN) ..... 2007 1 0125661

(51) Int. Cl.
*H01J 1/46* (2006.01)

(52) U.S. Cl. ..... 313/310; 313/346 DC; 313/306

(58) Field of Classification Search ..... 313/310, 313/337, 341, 346, 306, 307, 308; 977/939
See application file for complete search history.

(56) References Cited

U.S. PATENT DOCUMENTS

| | | | | |
|---|---|---|---|---|
| 5,905,335 | A | 5/1999 | Fushimi et al. | |
| 6,011,567 | A * | 1/2000 | Nakamura et al. | 347/115 |
| 2003/0160570 | A1 | 8/2003 | Sasaki et al. | |
| 2009/0167136 | A1 | 7/2009 | Liu et al. | |

FOREIGN PATENT DOCUMENTS

| | | | |
|---|---|---|---|
| CN | 1440044 | A | 9/2003 |
| CN | 1773664 | A | 5/2006 |
| CN | 101471211 | A | 7/2009 |

OTHER PUBLICATIONS

Cox et al., Thermionic emission from defective carbon nanotubes, Applied Physics Letters, Sep. 13, 2004, 2065-2067, vol. 85, No. 11.

* cited by examiner

*Primary Examiner* — Joseph L Williams
*Assistant Examiner* — Brenitra M Lee
(74) *Attorney, Agent, or Firm* — D. Austin Bonderer

(57) ABSTRACT

A thermionic emission device includes an insulating substrate, and one or more grids located thereon. Each grid includes a first, second, third and fourth electrode down-leads located on the periphery thereof, and a thermionic electron emission unit therein. The first and second electrode down-leads are parallel to each other. The third and fourth electrode down-leads are parallel to each other. The first and second electrode down-leads are insulated from the third and fourth electrode down-leads. The thermionic electron emission unit includes a first electrode, a second electrode, and a thermionic electron emitter. The first electrode and the second electrode are separately located and electrically connected to the first electrode down-lead and the third electrode down-lead respectively. The thermionic electron emitter includes at least one carbon nanotube wire.

14 Claims, 5 Drawing Sheets

THERMIONIC EMISSION DEVICE

RELATED APPLICATIONS

This application is related to commonly-assigned applications entitled, "METHOD FOR MAKING THERMIONIC ELECTRON SOURCE", filed Oct. 23,2008 Ser. No. 12/288,861"THERMIONIC ELECTRON SOURCE", filed Oct. 23, 2008 Ser. No. 12/288,865"THERMIONIC EMISSION DEVICE", filed Oct. 23, 2008 Ser. No. 12/288,863"THERMIONIC ELECTRON EMISSION DEVICE AND METHOD FOR MAKING THE SAME", filed Oct. 23, 2008 Ser. No. 12/288,864, and "THERMIONIC ELECTRON SOURCE", filed Oct. 23, 2008 Ser. No. 12/288,862.

BACKGROUND

1. Field of the Invention

The present invention relates to a thermionic emission device adopting carbon nanotubes.

2. Discussion of Related Art

Carbon nanotubes (CNT) are a carbonaceous material and have received much interest since the early 1990s. Carbon nanotubes have interesting and potentially useful electrical and mechanical properties. Due to these and other properties, CNTs have become a significant contributor to the research and development of electron emitting devices, sensors, and transistors, among other devices.

Generally, there are two kinds of electron-emitting devices; field emission devices and thermionic emission devices. A field emission device includes an insulating substrate, and a plurality of grids located thereon. Each grid includes first, second, third and fourth electrode down-leads located on the periphery of the grid. The first and the second electrode down-leads are parallel to each other. The third and fourth electrode down-leads are parallel to each other. The first and the second electrode down-leads are insulated from the third and fourth electrode down-leads.

A thermionic emission device, conventionally, comprises a plurality of thermionic electron emission units. Each thermionic electron emission unit includes a thermionic electron emitter and two electrodes. The thermionic electron emitter is located between the two electrodes and electrically connected thereto. The thermionic emitter is generally made of a metal, a boride, or an alkaline earth metal carbonate. The thermionic emitter, made of metal, can be a metal ribbon or a metal thread, and is fixed between the two electrodes by welding. The boride or alkaline earth metal carbonate can be dispersed in conductive slurry, whereupon the conductive slurry is directly coated or sprayed on a heater. The heater can be secured between the two electrodes as a thermionic electron emitter. However, it is hard to assemble a plurality of thermionic electron emission units, and the assembled thermionic emission device cannot realize uniform thermionic emission. Further, the size of the thermionic emitter using the metal, boride or alkaline earth metal carbonate is large, and thereby limits its application in micro-devices. Furthermore, the coating formed by direct coating or from spraying the metal, boride or alkaline earth metal carbonate has high resistivity, and thus, the thermionic electron source using the same has greater power consumption and is therefore not suitable for applications involving high current density and brightness.

What is needed, therefore, is a thermionic emission device having excellent thermal electron emitting properties, and can be used in flat panel displays with high current density and brightness, logic circuits, as well as in other fields using thermionic emission devices.

BRIEF DESCRIPTION OF THE DRAWINGS

Many aspects of the present thermionic emission device can be better understood with references to the following drawings. The components in the drawings are not necessarily drawn to scale, the emphasis instead being placed upon clearly illustrating the principles of the present thermionic emission device.

Figure 1:
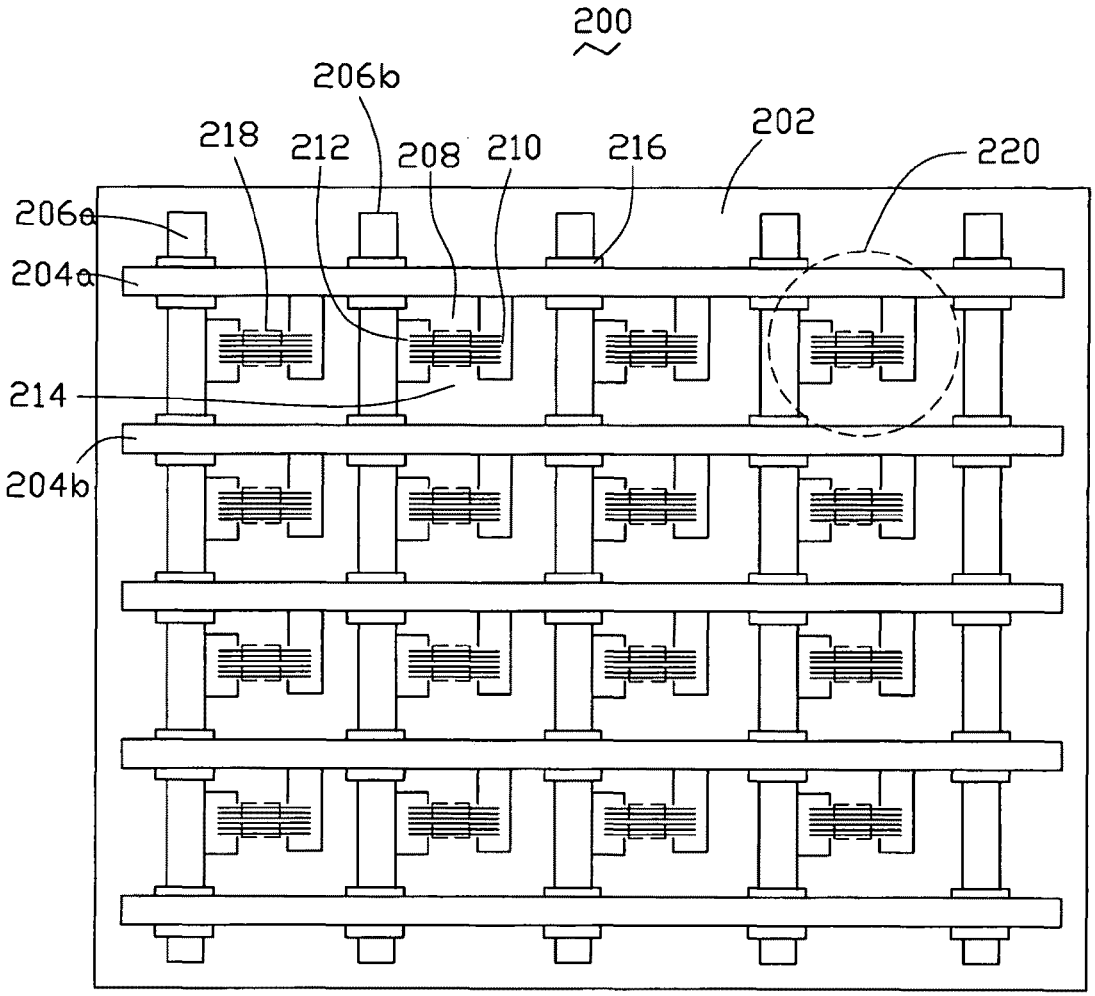
FIG. 1 is an exploded, isometric view of a thermionic emission device in accordance with the present embodiment.

Corresponding reference characters indicate corresponding parts throughout the views. The exemplifications set out herein illustrate at least one embodiment of the present thermionic emission device and method for making the same, in at least one form, and such exemplifications are not to be construed as limiting the scope of the invention in any manner.

DETAILED DESCRIPTION OF EXEMPLARY EMBODIMENTS

References will now be made to the drawings to describe, in detail, embodiments of the present thermionic emission device and method for making the same.

Referring to FIG. 1, a thermionic emission device 200 includes an insulating substrate 202, and one or more grids 214 located thereon. Each grid 214 includes a first electrode down-lead 204*a*, a second electrode down-lead 204*b*, a third electrode down-lead 206*a*, a fourth electrode down-lead 206*b*, located on the periphery of the gird 214, and a thermionic electron emission unit 220 located in each grid 214. The first electrode down-lead 204*a* and the second electrode down-lead 204*b*are parallel to each other. The third electrode down-lead 206*a*, and the fourth electrode down-leads 206*b*, are parallel to each other. Furthermore, a plurality of insulating layers 216 is sandwiched between the first and second electrode down-leads 204*a*, 204*b*, and the third and fourth electrode down-leads 206*a*, 206*b* to avoid short-circuiting. It is to be understood that the electrode down-leads of one grid can be different electrode down-leads for an adjacent gird. For example, the same electrode down-lead can be the first for one grid and the second for an adjacent grid.

One thermionic electron emission unit 220 is located in each grid 214. Each thermionic electron emission unit 220 includes a first electrode 210, a second electrode 212, and a thermionic electron emitter 208. The first electrode 210 and the second electrode 212 are separately located in the grid 214, and electrically connected to the thermionic electron emitter 208. The thermionic electron emitter 208 is suspended above the insulating substrate 202 by the first electrode 210 and the second electrode 212. The thermionic electron emitter 208 includes at least one carbon nanotube wire. All the thermionic electron emission units 220 may have a same number of carbon nanotube wires. If there are more than one, the carbon nanotube wires are parallel with each other. The first electrode 210 is electrically connected to a first electrode down-lead 204*a*. The second electrode 212 is electrically connected to a third electrode down-lead 206*a*. A plurality of grids 214 form an array, the first electrodes 210 in a row of grids 214 are electrically connected to a first electrode down-lead 204*a*, the second electrodes 212 in a column of grids 214 are electrically connected to a third electrode down-lead 206*a*. In the present embodiment, rows are perpendicular to columns.

The insulating substrate 202 is insulative, and can be made of ceramics, glass, resins, or quartz, among other materials. A size and shape of the insulating substrate 202 can be set as desired. In the present embodiment, the insulating substrate 202 is a glass substrate. Thickness of the insulating substrate 202 is greater than 1 millimeter, and length/width of the insulating substrate is greater than 1 centimeter. The insulating substrate 202 includes one or more recesses 218 located on the insulating substrate 202 corresponding to the grids 214. The recesses 218 may have the same size and are uniformly spaced from each other. Part of the thermionic electron emitter 208 is suspended above the surface of the insulating substrate 202 corresponding to the recesses 218. Therefore there is a space/air pocket between the thermionic electron emitter 208 and the insulating substrate 202. The space provides better insulation than direct contact between the substrate 202 and the emitter 208 would, thus the insulating substrate 202 will transfer less energy applied for heating the thermionic electron emitter 208 to the atmosphere, and as a result, the thermionic emission device 200 will have an excellent thermionic emitting property while consuming less energy.

The first through fourth electrode down-leads 204*a*, 204*b*, 206*a*, 206*b*, can be conductors, e.g., metal layers. In the present embodiment, the first through fourth electrode down-leads 204*a*, 204*b*, 206*a*, 206*b* are strip-shaped planar conductors formed by a screen-printing method. Widths of the first through fourth down-leads 204*a*, 204*b*, 206*a*, 206*b* approximately range from 30 micrometers to 1 millimeter, and thicknesses thereof approximately range from 5 micrometers to 1 millimeter, and distances therebetween approximately range from 300 micrometers to 5 millimeters. The first electrode down-lead 204*a* and the second electrode down-lead 204*b* cross the third electrode down-lead 206*a* and the fourth electrode down-leads 206*b* respectively. A preferred orientation of the first through fourth electrode down-leads 204*a*, 204*b*, 206*a*, 206*b* is that they be set at an angle with respect to each other. The angle approximately ranges from 10° to 90°. In the present embodiment, the angle is 90°. In the present embodiment, the first through fourth electrode down-leads 204*a*, 204*b*, 206*a*, 206*b* can be formed by printing conductive slurry on the insulating substrate 202 via a screen-printing method. The conductive slurry includes metal powder, low-melting glass powder and adhesive. The metal powder can be silver powder, and the adhesive can be ethyl cellulose or terpineol. A weight ratio of the metal powder in the conductive slurry approximately ranges from 50% to 90%. A weight ratio of the low-melting glass powder in the conductive slurry approximately ranges from 2% to 10%. A weight ratio of the adhesive in the conductive slurry approximately ranges from 10% to 40%.

The first electrode 210 and the second electrode 212 can be conductors, e.g., metal layers. In the present embodiment, the first electrode 210 and the second electrode 212 are planar conductors formed by a screen-printing method. Sizes of the first electrode 210 and the second electrode 212 are determined by the size of the grid 214. Lengths of the first electrode 210 and the second electrode 212 approximately range from 30 micrometers to 1 millimeter, widths thereof approximately range from 30 micrometers to 1 millimeter, and thicknesses thereof approximately range from 5 micrometers to 1 millimeter. A distance between the first electrode 210 and the second electrode 212 approximately ranges from 50 micrometers to 1 millimeter. In the present embodiment, a length of the first electrode 210 and the second electrode 212 is 60 micrometers, a width of each is 40 micrometers, and a thickness of each is 20 micrometers. The first electrode 210 and the second electrode 212 can be formed by printing conductive slurry on the insulating substrate 202 via screen-printing. Ingredients of the conductive slurry are the same as the conductive slurry used to form the electrode down-leads.

Figure 2:
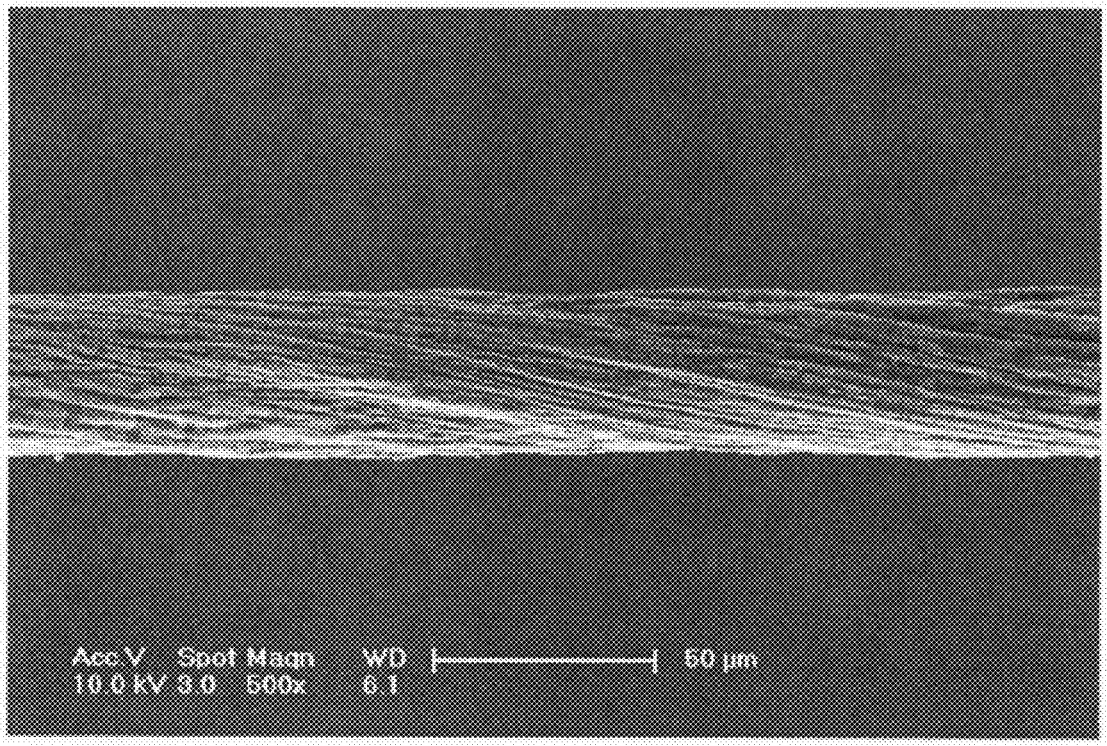
FIG. 2 shows a Scanning Electron Microscope (SEM) image of a carbon nanotube wire used in the thermionic emission device of FIG. 1.

The thermionic electron emitter 208 includes at least one carbon nanotube wire. Referring to FIG. 2, each carbon nanotube wire is composed of a plurality of successively carbon nanotubes joined end to end by van der Waals attractive force therebetween and one or more nanotubes in thickness. The carbon nanotube wire can be formed by treating, chemically or mechanically, a carbon nanotube film drawn from a carbon nanotube array. The length of the carbon nanotube wire can be arbitrarily set as desired. A diameter of each carbon nanotube wire approximately ranges from 0.5 nanometers to 100 micrometers (μm). The carbon nanotubes in the carbon nanotube wires can be selected from a group consisting of single-walled, double-walled, and multi-walled carbon nanotubes. A diameter of each single-walled carbon nanotube approximately ranges from 0.5 nanometers to 50 nanometers. A diameter of each double-walled carbon nanotube approximately ranges from 1 nanometer to 50 nanometers. A diameter of each multi-walled carbon nanotube approximately ranges from 1.5 nanometers to 50 nanometers.

Figure 3:
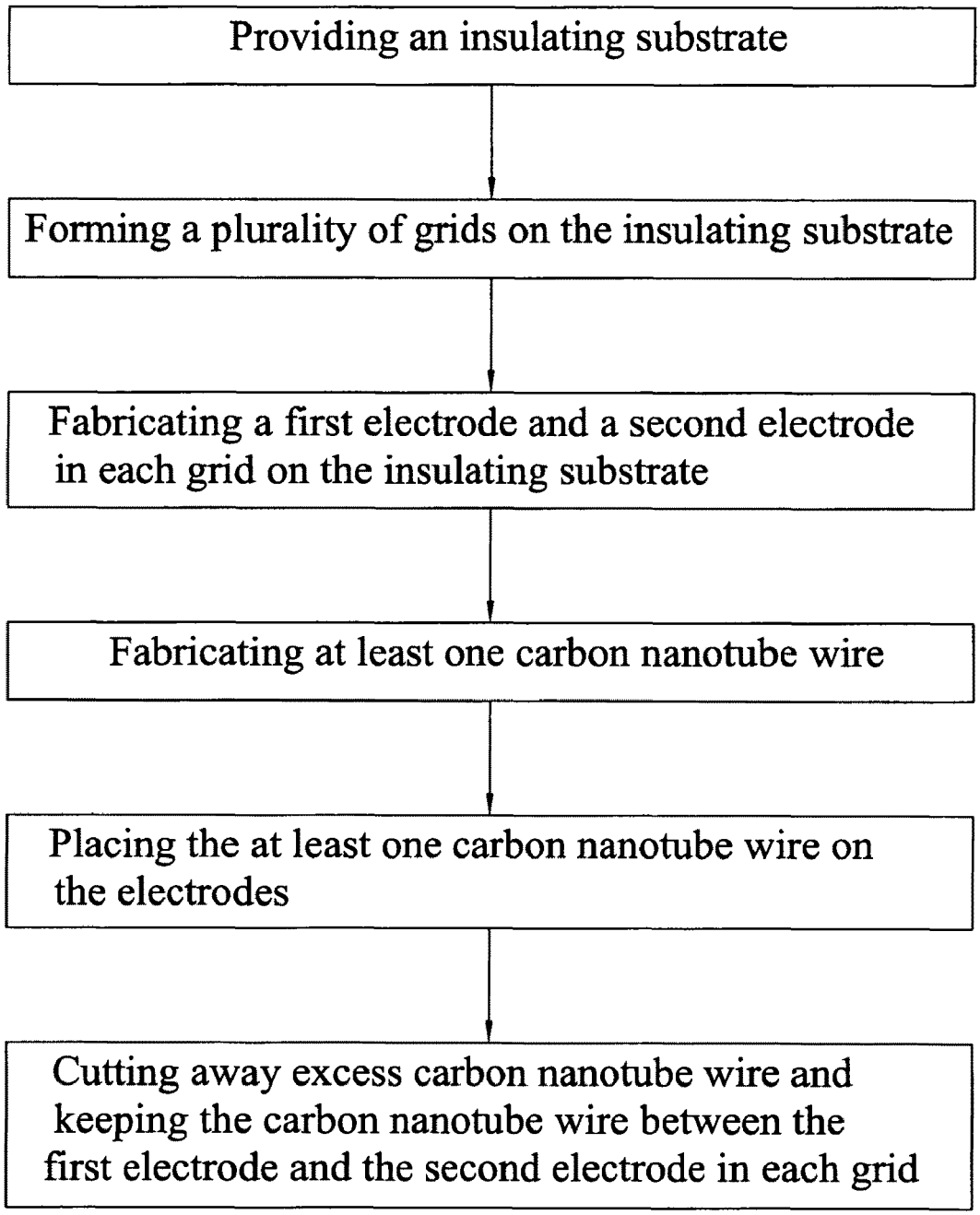
FIG. 3 is a flow chart of a method for making a thermionic emission device, in accordance with the present embodiment.

Referring to FIG. 3, a method for making a thermionic emission device includes the following steps of: (a) providing an insulating substrate; (b) forming a plurality of grids on the insulating substrate; (c) fabricating a first electrode and a second electrode in each grid on the insulating substrate; (d) fabricating at least one carbon nanotube wire; (e) placing the at least one carbon nanotube wire on the electrodes; and (f) cutting away excess carbon nanotube wire and keeping the carbon nanotube wire between the first electrode and the second electrode in each grid.

In step (a), the insulating substrate can be made of ceramics, glass, resins, or quartz, among other insulating materials. In the present embodiment, the insulating substrate is a glass substrate. Step (a) can further includes a step of etching a plurality of uniformly-spaced recesses with a predetermined size on the insulating substrate.

Step (b) can be executed by screen printing a plurality of uniformly-spaced first electrode down-leads and second electrode down-leads parallel to each other on the insulating substrate; a plurality of uniformly-spaced insulating layers on the first electrode down-leads and second electrode down-leads; and a plurality of third electrode down-lead, fourth electrode down-leads on the insulating layers parallel to each other on the insulating substrate. The first and second electrode down-leads are insulated from the third and fourth electrode down-leads by the insulating layer at the crossover regions thereof. The first through fourth electrode down-leads can be electrically connected together by a connection external to the grid. It can be understood that the plurality of recesses can also be formed after step (b).

Step (c) can be executed by fabricating a plurality of first electrodes on the first electrode down-lead and a plurality of second electrodes on the third electrode down-lead corresponding to each grid via a screen-printing method, an evaporation method, or a sputtering method.

In step (c), in the present embodiment, a screen-printing method can be used to make the first electrodes and the second electrodes. The first electrode and the second electrode are located a certain distance apart. The first electrode is electrically connected to the first electrode down-lead, and the second electrode is electrically connected to the second electrode down-lead.

Step (d) includes the following steps of: (d1) providing an array of carbon nanotubes or providing a super-aligned array of carbon nanotubes; (d2) pulling out a carbon nanotube structure from the array of carbon nanotubes, by using a tool (e.g., adhesive tape, pliers, tweezers, or another tool allowing multiple carbon nanotubes to be gripped and pulled simultaneously); and (d3) treating the carbon nanotube structure with an organic solvent or mechanical force to form a carbon nanotube wire.

In step (d1), a given super-aligned array of carbon nanotubes can be formed by the following substeps: firstly, providing a substantially flat and smooth substrate; secondly, forming a catalyst layer on the substrate; thirdly, annealing the substrate with the catalyst layer thereon in air at a temperature approximately ranging from 700° C. to 900° C. for about 30 to 90 minutes; fourthly, heating the substrate with the catalyst layer to a temperature approximately ranging from 500° C. to 740° C. in a furnace with a protective gas therein; and fifthly, supplying a carbon source gas to the furnace for about 5 to 30 minutes and growing the super-aligned array of carbon nanotubes on the substrate.

The substrate can be a P-type silicon wafer, an N-type silicon wafer, or a silicon wafer with a film of silicon dioxide thereon. In the present embodiment, a 4-inch P-type silicon wafer is used as the substrate. The catalyst can be made of iron (Fe), cobalt (Co), nickel (Ni), or any alloy thereof. The protective gas can be made up of at least one of nitrogen (N2), ammonia (NH3), and a noble gas. The carbon source gas can be a hydrocarbon gas, such as ethylene (C2H4), methane (CH4), acetylene (C2H2), ethane (C2H6), or any combination thereof.

The super-aligned array of carbon nanotubes can be approximately 200to 400 microns in height and include a plurality of carbon nanotubes parallel to each other and approximately perpendicular to the substrate. The carbon nanotubes in the array can be selected from a group consisting of single-walled carbon nanotubes, double-walled carbon nanotubes, or multi-wall carbon nanotubes. A diameter of the single-walled carbon nanotubes approximately ranges from 0.5 to 50 nanometers. A diameter of the double-walled carbon nanotubes approximately ranges from 1 to 10 nanometers. A diameter of the multi-walled carbon nanotubes approximately ranges from 1.5 to 10 nanometers.

The super-aligned array of carbon nanotubes formed under the above conditions is essentially free of impurities such as carbonaceous or residual catalyst particles. The carbon nanotubes in the super-aligned array are closely packed together by the van der Waals attractive force.

Step (d2) can be executed by selecting one or more carbon nanotubes having a predetermined width from the array of carbon nanotubes; and pulling the carbon nanotubes to form carbon nanotube segments at an even/uniform speed to achieve a uniform carbon nanotube film.

Figure 4:
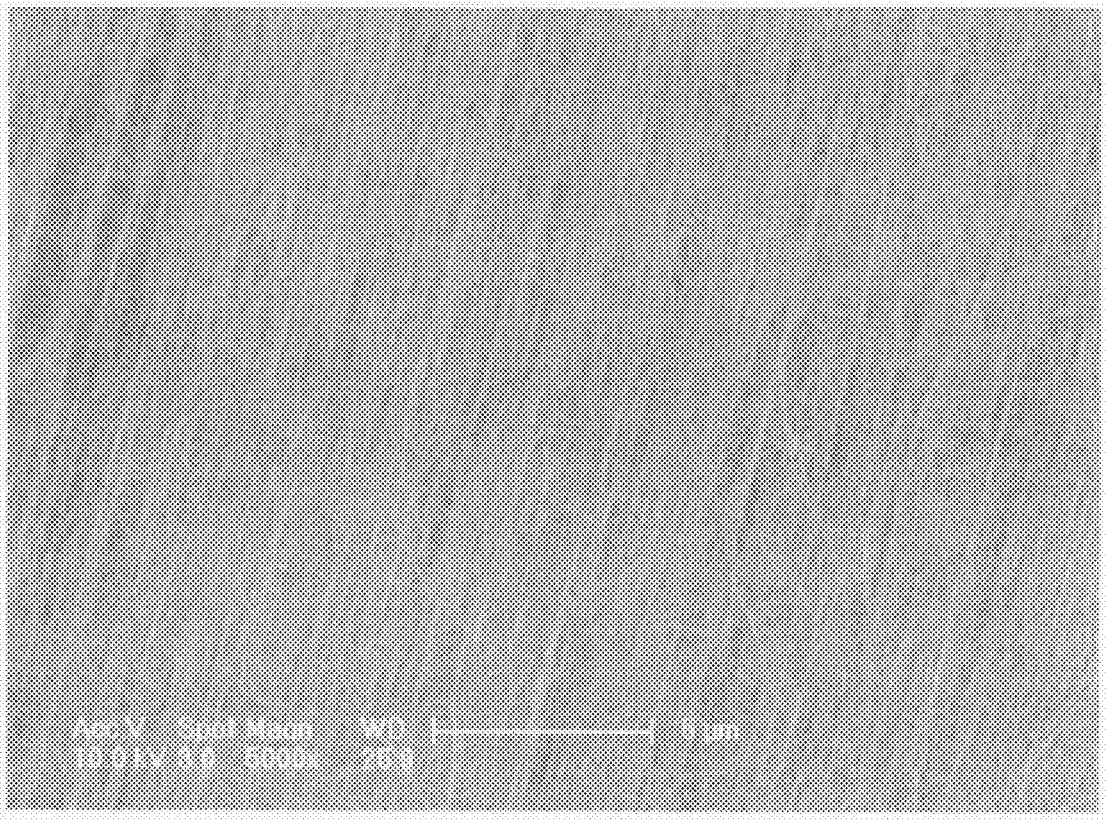
FIG. 4 shows a Scanning Electron Microscope (SEM) image of a carbon nanotube film.
Figure 5:
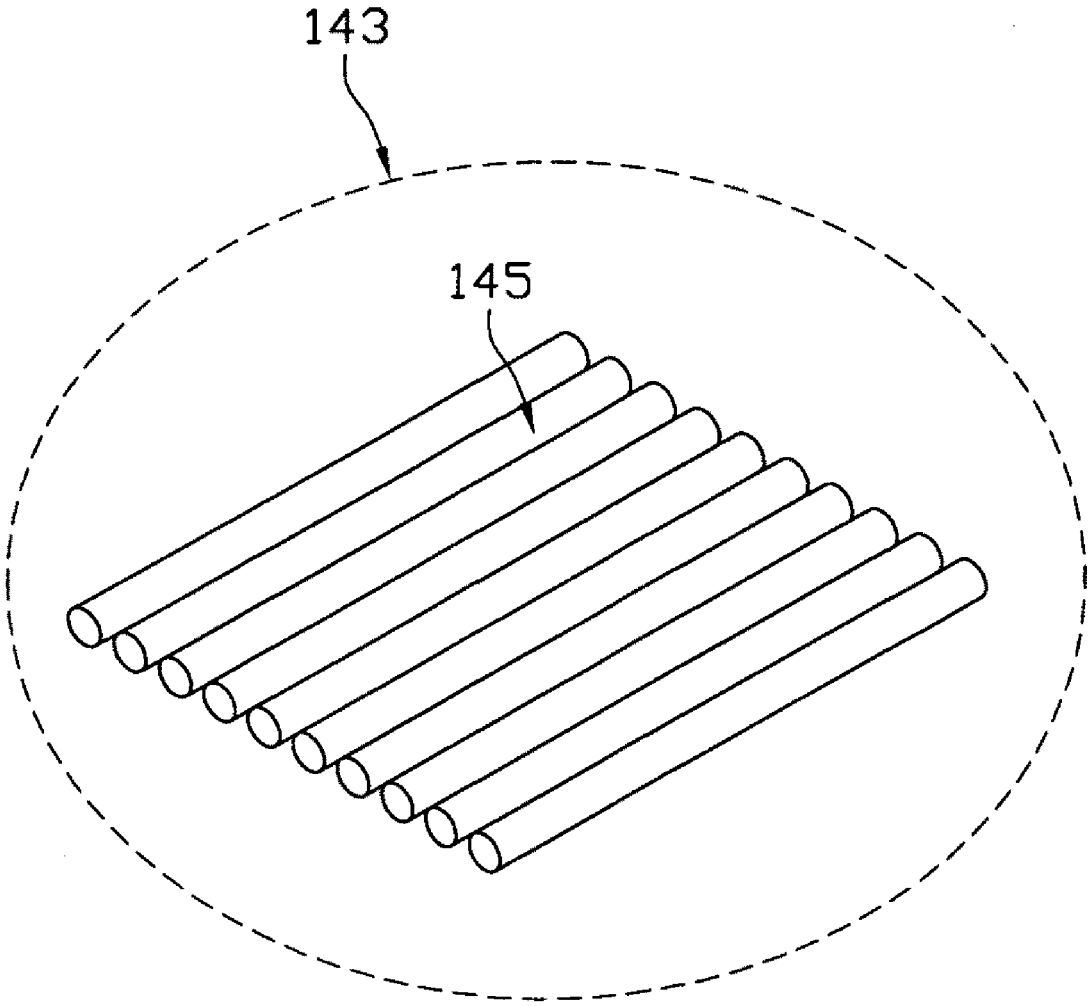
FIG. 5 is a structural schematic of a carbon nanotube segment.

The carbon nanotube segments can be selected by using a tool, such as adhesive tapes, pliers, tweezers, or another tools allowing multiple carbon nanotubes to be gripped and pulled simultaneously to contact with the super-aligned array. Referring to FIG. 4 and FIG. 5, each carbon nanotube segment 143 includes a plurality of carbon nanotubes 145 parallel to each other, and combined by van der Waals attractive force therebetween. The carbon nanotube segments 145 can vary in width, thickness, uniformity and shape. The pulling direction is substantially perpendicular to the. growing direction of the super-aligned array of carbon nanotubes.

More specifically, during the pulling process, as the initial carbon nanotube segments 143 are drawn out, other carbon nanotube segments 143 are also drawn out end to end due to the van der Waals attractive force between ends of adjacent carbon nanotube segments 143. This process of drawing ensures a continuous, uniform carbon nanotube structure can be formed. The carbon nanotubes 145 in the carbon nanotube film are all substantially parallel to the pulling/drawing direction of the carbon nanotube film, and the carbon nanotube film produced in such manner can be selectively formed having a predetermined width. The carbon nanotube film formed by the pulling/drawing method has superior uniformity of thickness and conductivity over a disordered carbon nanotube film. Furthermore, the pulling/drawing method is simple, fast, and suitable for industrial applications. It is to be understood that some variation can occur in the orientation of the nanotubes in the film as can be seen in FIG. 4.

Step (e) can be executed by applying at least one carbon nanotube wire on the insulating substrate along a direction extending from the first electrode to the second electrode. Carbon nanotube wires are parallel with each other, and are uniformly spaced or contactly placed with each other.

Since the carbon nanotube film has a high surface-area-to-volume ratio, the carbon nanotube wire formed by the carbon nanotube film may easily adhere to other objects. Thus, the carbon nanotube wire can directly be fixed on the insulating substrate due to the adhesive properties of the nanotubes. The carbon nanotube wire can also be secured on the insulating substrate via adhesive or conductive glue.

Further, at least one fixing electrode (not shown), formed on the carbon nanotube wire corresponding to the first electrode and the second electrode, can be further provided to fix the carbon nanotube wire on the first electrode and the second electrode firmly.

Step (f) can be executed by a laser ablation method or an electron beam scanning method. In the present embodiment, step (f) is executed by a laser ablation method. Step (f) includes the following steps of: (f1) scanning the carbon nanotube wire along each first electrode down-lead via a laser beam, and (f2) scanning the carbon nanotube wire along each third electrode down-lead via a laser beam to cut the carbon nanotube wire applied on the insulating substrate except that between the first electrodes and the second electrodes. The laser beam has a power approximately ranging from 10 watts to 50 watts and a scanning speed approximately ranging from 10 millimeters/second to 5000 millimeters/second. In the present embodiment, the power of the laser beam is 30 watts; a scanning speed thereof is 100 millimeters/second.

In step (f1), a width of the laser beam is equal to a distance between the adjacent first electrodes along the aligned direction of the third electrode down-lead, and approximately ranges from 20 micrometers to 500 micrometers. Step (f1) is executed to cut the carbon nanotube wire between adjacent second electrodes in adjacent grid respectively along the aligned direction of the third electrode down-lead. In step (f2), a width of the laser beam is equal to a distance between adjacent first electrode and second electrode in adjacent grid respectively along the aligned direction of the first electrode down-lead, and approximately ranges from 20 micrometers to 500 micrometers. Step (f2) is executed to cut the carbon nanotube wire between adjacent first electrode and second electrode in adjacent grid respectively along the aligned direction of the first electrode down-lead.

Compared to conventional technologies, the method for making the thermionic emission device provided by the present embodiments has many advantages including the following. Firstly, since the carbon nanotube wire is formed by treating the carbon nanotube film pulled from a carbon nanotube array, the method is simple and low-cost. Secondly, since the carbon nanotubes in the carbon nanotube wire are uniformly spaced with each other, the thermionic electron emitter adopting the carbon nanotube wire prepared by the present embodiment can acquire a uniform and stable thermal electron emissions state. Thirdly, since the thermionic electron emitter and the insulating substrate are separately located (a space located therebetween), the insulating substrate will transfer less energy for heating the thermionic electron emitter to the atmosphere in the process of heating, and as a result, the thermionic emission device will have an excellent thermionic emitting property. Fourthly, the carbon nanotube wire is easy to dope with low work function materials. The thermiomic emission property can be easily enhanced. Finally, since the carbon nanotube wire has a small width and a low resistance, the thermionic emission device adopting the carbon nanotube wire can emit electrons at a low thermal power, thus the thermionic emission device can be used for high current density and high brightness of the flat panel display and logic circuits, among other fields.

Finally, it is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

It is also to be understood that the above description and the claims drawn to a method may include some indication in reference to certain steps. However, the indication used is only to be viewed for identification purposes and not as a suggestion as to an order for the steps.

What is claimed is:

1. A thermionic emission device comprising:

an insulating substrate;

one or more grids located on the insulating substrate, wherein each grid comprises:

a first, second, third and fourth electrode down-leads located on the periphery of the gird, wherein the first and the second electrode down-leads are parallel to each other, the third and fourth electrode down-leads are parallel to each other, and the first and the second electrode down-leads are insulated from the third and fourth electrode down-leads respectively; and a thermionic electron emission unit, the thermionic electron emission unit comprises a first electrode, a second electrode, and a thermionic electron emitter, the first electrode and the second electrode separately located and electrically connected to the first electrode down-lead and the third electrode down-lead respectively;

wherein the thermionic electron emitter comprises at least one carbon nanotube wire.

2. The thermionic emission device as claimed in claim 1, wherein at least a portion of the thermionic electron emitter is suspended above the insulating substrate by the first electrode and the second electrode.

3. The thermionic emission device as claimed in claim 1, further comprising one or more recesses located on a surface of the insulating substrate.

4. The thermionic emission device as claimed in claim 3, wherein the one or more recesses have a same size and are uniformly spaced with each other.

5. The thermionic emission device as claimed in claim 4, wherein the thermionic electron emitter is located above one corresponding recesses.

6. The thermionic emission device as claimed in claim 1, wherein a plurality of grids forms an array, the first electrodes in a row of grids are electrically connected to the first electrode down-lead, and the second electrodes in a column of grids are electrically connected to the third electrode down-lead.

7. The thermionic emission device as claimed in claim 1, wherein a thickness of the first electrode and the second electrode approximately ranges from 5 micrometers to 1 millimeter.

8. The thermionic emission device as claimed in claim 1, wherein a distance between the first electrode and the second electrode approximately ranges from 50 micrometers to 1 millimeter.

9. The thermionic emission device as claimed in claim 1, wherein each grid comprises a predetermined number of uniformly-spaced carbon nanotube wires parallel with each other.

10. The thermionic emission device as claimed in claim 1, wherein a diameter of the carbon nanotube wire approximately ranges from 0.5 nanometers to 100 micrometers.

11. The thermionic emission device as claimed in claim 1, wherein the carbon nanotube wire is composed of a plurality of successively carbon nanotubes joined end to end by van der Waals attractive force therebetween.

12. The thermionic emission device as claimed in claim 11, wherein the carbon nanotube wire extends from the first electrode to the second electrode.

13. The thermionic emission device as claimed in claim 11, wherein the carbon nanotubes in the carbon nanotube wire are selected from a group consisting of single-walled carbon nanotubes, double-walled carbon nanotubes, and multi-walled carbon nanotubes.

14. The thermionic emission device as claimed in claim 13, wherein diameters of the single-walled carbon nanotubes approximately range from 0.5 nanometers to 50 nanometers, diameters of the double-walled carbon nanotubes approximately range from 1 nanometer to 50 nanometers, and diameters of the multi-walled carbon nanotubes approximately range from 1.5 nanometers to 50 nanometers.

* * * * *